US011476601B2

(12) United States Patent
Oosaka

(10) Patent No.: US 11,476,601 B2
(45) Date of Patent: Oct. 18, 2022

(54) CONNECTOR CAPABLE OF APPROPRIATELY RESTRICTING MOVEMENT OF A CONTACT

(71) Applicant: Japan Aviation Electronics Industry, Limited, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/227,680

(22) Filed: Apr. 12, 2021

(65) Prior Publication Data

US 2021/0359437 A1 Nov. 18, 2021

(30) Foreign Application Priority Data

May 13, 2020 (JP) ..... JP2020-084468
May 26, 2020 (JP) ..... JP2020-091146
Jun. 12, 2020 (JP) ..... JP2020-102280

(51) Int. Cl.
*H01R 12/58* (2011.01)
*H01R 13/518* (2006.01)
(Continued)

(52) U.S. Cl.
CPC ..... *H01R 12/585* (2013.01); *H01R 13/502* (2013.01); *H01R 13/518* (2013.01); *H01R 13/6581* (2013.01)

(58) Field of Classification Search
CPC ..... H01R 12/585; H01R 13/502; H01R 13/518; H01R 13/6581
(Continued)

(56) References Cited

U.S. PATENT DOCUMENTS 7,059,908 B2 * 6/2006 Yamaguchi ..... H01R 13/6583 439/607.17
7,828,559 B2 * 11/2010 Chen ..... H01R 12/716 439/74
(Continued)

FOREIGN PATENT DOCUMENTS

CN 109193197 B 8/2020
JP 2012-18781 A 1/2012
(Continued)

OTHER PUBLICATIONS

Office Report from corresponding TW application 110112710, dated Aug. 2, 2022, 8 pages.

*Primary Examiner* — Peter G Leigh
(74) *Attorney, Agent, or Firm* — Muncy, Geissler, Olds & Lowe, P.C.

(57) ABSTRACT

In a connector, movement of a contact is appropriately restricted in detaching a counter connector from the connector. The connector fittable with the counter connector in a first direction includes the contact and a housing. The contact includes: a press-fitted portion press-fitted into the housing in a second direction intersecting the first direction; an extension portion that extends from the press-fitted portion in a third direction intersecting the first and the second directions; and a contact portion that extends from the extension portion and contacts the counter contact. The housing includes a protrusion portion that protrudes from a rising portion in the third direction. In a state where the press-fitted portion is press-fitted in the housing, a surface of a distal end portion in the third direction of the extension portion contacts the protrusion portion, which surface faces a side where the counter connector is situated.

16 Claims, 10 Drawing Sheets

(51) Int. Cl.
*H01R 13/502* (2006.01)
*H01R 13/6581* (2011.01)

(58) Field of Classification Search
USPC ..... 439/751
See application file for complete search history.

(56) References Cited

U.S. PATENT DOCUMENTS

| | | | | |
|---|---|---|---|---|
| 9,425,526 | B2 * | 8/2016 | Uratani | H01R 12/716 |
| 10,396,479 | B2 * | 8/2019 | Hoshiba | H01R 12/716 |
| 10,446,985 | B2 * | 10/2019 | Ooi | H01R 12/73 |
| 10,644,419 | B2 * | 5/2020 | Ishida | H01R 12/716 |
| 10,651,599 | B2 * | 5/2020 | Hashiguchi | H01R 12/91 |
| 2007/0087590 | A1 * | 4/2007 | Korsunsky | H05K 7/1069 439/74 |
| 2015/0079853 | A1 * | 3/2015 | Tsai | H01R 12/73 439/751 |
| 2018/0183168 | A1 * | 6/2018 | Sugaya | H01R 12/716 |
| 2019/0280409 | A1 * | 9/2019 | Hoshiba | H01R 12/716 |
| 2019/0319382 | A1 * | 10/2019 | Yukutake | H01R 13/6594 |
| 2020/0067217 | A1 * | 2/2020 | Ashibu | H01R 12/716 |
| 2020/0083643 | A1 * | 3/2020 | Hashiguchi | H01R 12/91 |

FOREIGN PATENT DOCUMENTS

| | | | | |
|---|---|---|---|---|
| JP | 2019087515 | A * | 6/2019 | A41D 1/002 |
| WO | WO-2018163919 | A1 * | 9/2018 | H01R 12/716 |

* cited by examiner

CONNECTOR CAPABLE OF APPROPRIATELY RESTRICTING MOVEMENT OF A CONTACT

BACKGROUND OF THE INVENTION

The present invention relates to a connector, particularly to a connector fittable with a counter connector and having a contact that contacts a counter contact.

BACKGROUND ART

As one example of a connector that is fitted to a counter connector in the vertical direction, a connector described in JP 2012-18781 A (hereinafter called "connector 1") can be noted. The connector 1 is a receptacle connector and is fitted to a counter connector 2 that is a plug connector. As shown in FIG. 18, the connector 1 includes a housing 3 and contacts 4 fixed to the housing 3. The housing 3 has a bottom wall 3B formed inside an annular wall 3A and a projection portion 3C rising from a central part of the bottom wall 3B. A top portion of the projection portion 3C horizontally extends in the form of a flange as shown in FIG. 18.

Each contact 4 is a strip-like electrically conductive member having elasticity and is mounted to the housing 3 by being press-fitted into a groove formed in the annular wall 3A. As shown in FIG. 18, the contact 4 has a terminal portion 4A joined to a circuit board, a retention portion 4B extending upward from one end of the terminal portion 4A, a connection portion 4C horizontally extending from one end of the retention portion 4B, and a curved portion 4D formed to extend downward from one end of the connection portion 4C, be gently curved to extend in a horizontal direction, and then rise upward. As shown in FIG. 18, the curved portion 4D has an apex portion 5, two lateral portions 6 and 7 situated on the opposite sides across the apex portion 5, and a bent portion 8 bent in a V-shape from an end of the lateral portion 7.

When the connector 1 is fitted to the counter connector 2, as shown in FIG. 18, contacts (counter contacts 9) of the counter connector 2 are inserted into the curved portions 4D of the contacts 4 that are curved to open toward the counter connector 2. At this time, as shown in FIG. 19, the curved portion 4D is expanded by the counter contact 9 and elastically deforms such that the lateral portion 7 approaches the projection portion 3C, and the bent portion 8 goes into a space under the top portion of the projection portion 3C extending in the form of a flange and is locked by the top portion. As a consequence, upward movement of the contact 4 (that is, floating of the contact 4) in a connector-fitted state is restricted.

SUMMARY OF INVENTION

As described above, the connector 1 has the bent portion 8 that is configured to be locked by the projection portion 3C upon elastic deformation of the curved portion 4D. In other words, the position of the curved portion 8 changes upon attachment or detachment of the counter connector 2 to or from the connector 1. When the counter connector 2 is detached from the connector 1 (i.e., when the counter contact 9 is pulled out from the contact 4), as can be seen from FIG. 18, locking of the bent portion 8 by the top portion of the projection portion 3C is released, so that floating of the contact 4 is hardly restricted.

Aside from that, for instance, when the shape of the projection portion 3C, the elasticity of the curved portion 4D or the like changes due to repetitive attachment and detachment of the counter connector 2, the position of the bent portion 8 in the connector-fitted state may vary in the vertical direction.

With the configuration in which the position of the bent portion 8 is not stable as above, the contact 4 may unintentionally move in the vertical direction, and this may adversely affect the properties of signals transmitted by the contact 4 and the like.

The present invention has been made in view of the above circumstances and is aimed at achieving an object described below.

An object of the invention is to solve the above problem of the conventional art by providing a connector capable of appropriately restricting movement of a contact, particularly floating of a contact that may occur when a counter connector is detached from the connector.

To attain the foregoing object, the present invention provides a connector fittable with a counter connector in a first direction, the connector comprising: a contact that contacts a counter contact included in the counter connector; and a housing to which the contact is fitted and attached, the contact including: a press-fitted portion that extends in a second direction intersecting the first direction and has an end portion in the second direction which is press-fitted into the housing; an extension portion that extends from the press-fitted portion in a third direction intersecting the first direction and the second direction; and a contact portion that extends from the extension portion in the first direction and contacts the counter contact, the housing including: a rising portion that rises in the first direction; and a protrusion portion that protrudes from the rising portion in the third direction, wherein in a state where the press-fitted portion is press-fitted in the housing, a surface of a distal end portion in the third direction of the extension portion contacts the protrusion portion, which surface faces a side where the counter connector is situated in the first direction.

According to the connector of the invention configured as above, in the state where the press-fitted portion is press-fitted in the housing, the surface (upper surface) of the distal end portion of the extension portion of the contact contacts the protrusion portion of the housing, which surface faces a side where the counter connector is situated in the first direction. With this configuration, it is possible to minimize upward movement, i.e., floating of the contact well.

In the above configuration, when the contact is fitted to the housing, the press-fitted portion may be press-fitted into the housing along the third direction. In this case, the first direction that is the fitting direction of the connector and the third direction that is the press-fitting direction of the contact intersect each other, and this configuration makes it possible to minimize floating of the contact more appropriately compared to the configuration that the above two directions extend along each other (e.g., the configuration described in JP 2012-18781 A). Preferably, the first direction and the third direction are perpendicular to each other.

In the above configuration, the contact portion may have a pair of elastic portions that extends from opposite end surfaces in the second direction of the extension portion. In this case, the pair of elastic portions has a symmetric shape with respect to a middle position in the second direction of the extension portion, and when the connector is fitted to the counter connector, the pair of elastic portions elastically deforms to pinch the counter contact between the elastic portions.

With this configuration, it is possible to appropriately restrict floating of the contact with the contact contacting the counter contact well.

In the above configuration, the contact may have a connection portion that extends from the press-fitted portion on an opposite side from the extension portion in the third direction. In this case, preferably, the connection portion is fixed to a surface of a circuit board on which the connector is mounted.

In the above configuration, preferably, a contact surface that is provided in the distal end portion of the extension portion and contacts the protrusion portion and a contact surface that is provided in the protrusion portion and contacts the extension portion are plane surfaces extending along the second direction and the third direction. In this case, the protrusion portion and the distal end portion of the extension portion make a surface contact with each other via their plane surfaces parallel to each other, and therefore, floating of the contact can be restricted by the protrusion portion more reliably and effectively.

In the above configuration, when the contact is a contact for high frequency signal transmission, it is more preferable. In the connector provided with the contact for high frequency signal transmission, signal properties are easily affected by displacement in position (floating) in the vertical direction. In this case, the effect of minimizing floating according to the invention is more remarkably demonstrated.

In the above configuration, preferably, in the state where the press-fitted portion is press-fitted in the housing, the rising portion adjoins the distal end portion of the extension portion in the third direction, and the protrusion portion protrudes from a surface of the rising portion which surface faces the extension portion. When the protrusion portion protrudes from the surface of the rising portion on the side closer to the extension portion, the distal end portion of the extension portion is allowed to contact the protrusion portion more easily.

In the above configuration, preferably, the housing has a restriction portion that contacts the extension portion on an opposite side from the protrusion portion in the first direction in a state where the press-fitted portion is press-fitted in the housing. In this case, when the counter connector is fitted to the connector, that is, when the counter contact is inserted into the contact, downward movement of the contact (i.e., sinking of the contact) can be minimized.

The invention makes it possible to appropriately restrict movement of a contact, particularly floating of a contact that may occur when a counter connector is detached from the connector.

DETAILED DESCRIPTION OF THE INVENTION

<<Regarding Connector According to Embodiment of Present Invention>>

A connector according to an embodiment of the invention is specifically described below with reference to the appended drawings.

It should be noted that the embodiment described below is merely an example used to facilitate the understanding of the invention, and the invention is by no means limited thereto. In other words, the invention may be modified or improved from the embodiment described below without departing from the scope and spirit of the invention. In particular, the materials, design dimensions and other factors of components used in the invention can be freely determined depending on the application of the invention, the state of the art at the time when the invention is implemented, and other conditions. Needless to say, the invention includes its equivalents.

Figure 1:
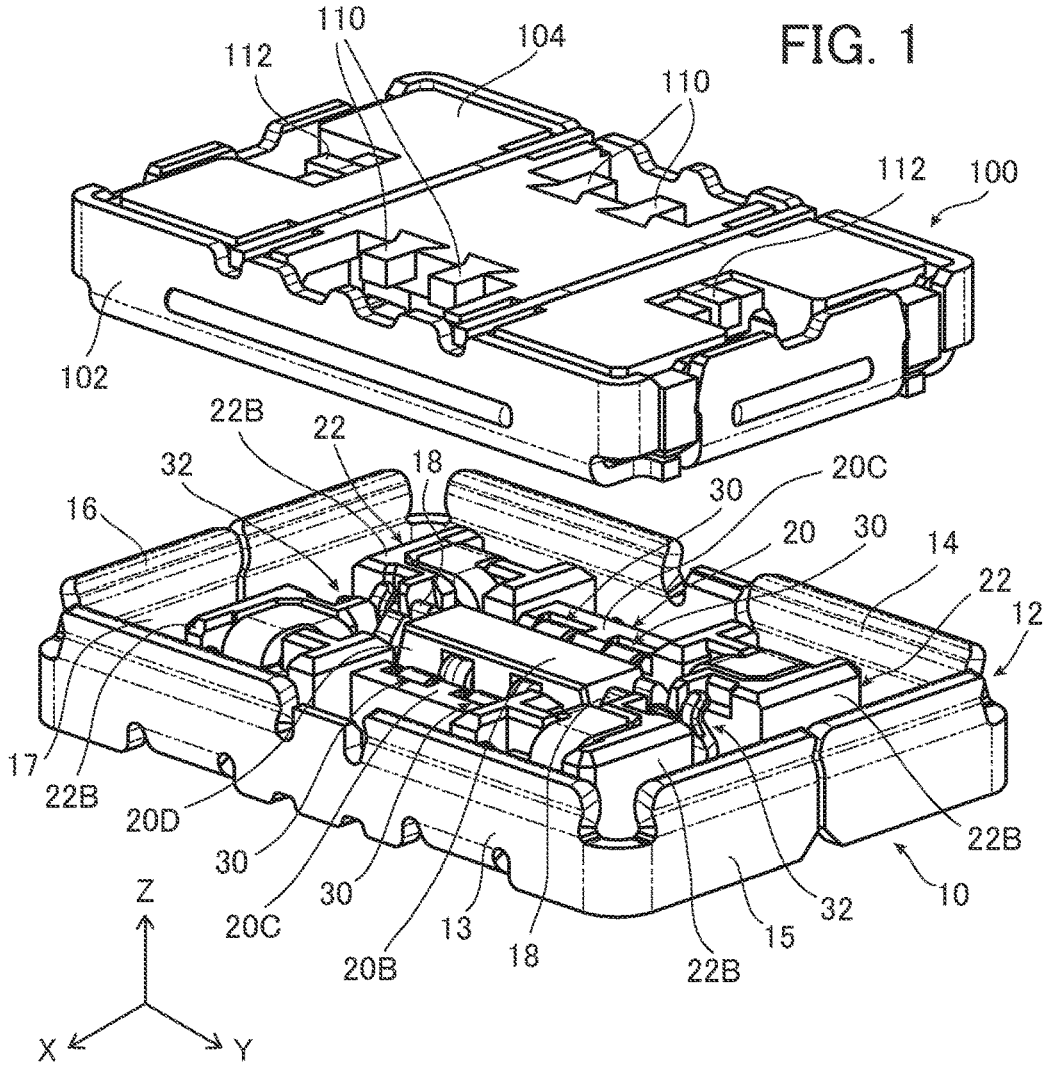
FIG. 1 is a perspective view showing a connector and a counter connector according to an embodiment of the invention.
Figure 2:
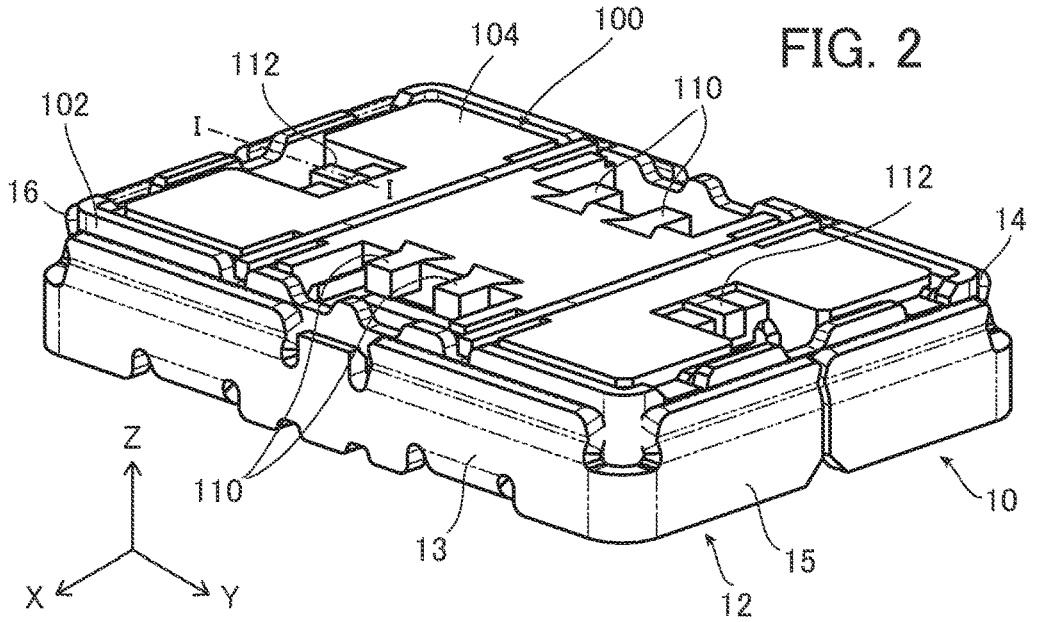
FIG. 2 is a perspective view showing the connector in the state where the connector is fitted with the counter connector.

The connector according to the embodiment (hereinafter called "connector 10") is a receptacle connector, is mounted on a circuit board which is not shown, and is fitted to a counter connector 100 that is a plug connector as shown in FIGS. 1 and 2.

The direction in which the connector 10 is fitted to the counter connector 100, i.e., the direction in which the counter connector 100 is attached to or detached from the connector 10 corresponds to "first direction" of the invention and is equivalent to the vertical direction of the connector 10. In the following description, for convenience of description, the fitting direction of the connector 10 is called "Z direction," and the side on which the counter connector 100 is situated when viewed from the connector 10 in the Z direction, i.e., the upper side of the connector 10 is defined as "+Z side," while the opposite side therefrom, i.e., the lower side of the connector 10 is defined as "−Z side."

In the following description, two directions perpendicular to the Z direction are defined as "X direction" and "Y direction." Those three directions cross one another, more strictly, are perpendicular to one another. In the present description, the term "perpendicular" includes a margin of error that is generally allowed in the field of connectors, and the term covers a condition having displacement within a range of several angles (e.g., 2° to 3°) with respect to the strictly perpendicular arrangement. Likewise, in the present description, the term "parallel" includes a margin of error that is generally allowed in the field of connectors, and the term covers a condition having displacement within a range of several angles (e.g., 2° to 3°) with respect to the strictly parallel arrangement.

The X direction corresponds to "second direction" of the invention and is equivalent to the lateral width direction of the connector 10. The Y direction corresponds to "third direction" of the invention, is equivalent to the front-back direction of the connector 10, and is a direction in which a contact 30 is press-fitted to the housing 20 which will be described later. One orientation in the Y direction (specifically, the side on which a frame front portion 15 is situated when viewed from a frame back portion 16 which will be described later) is defined as "+Y side," and the opposite side therefrom is defined as "−Y side."

The connector 10 has the appearance shown in FIGS. 3 to 6 and includes an outer frame 12 having a rectangular shape in a plan view, housings 20 and 22 disposed inside the outer frame 12, and contacts 30 and 32 attached to the housings 20 and 22.

Figure 7:
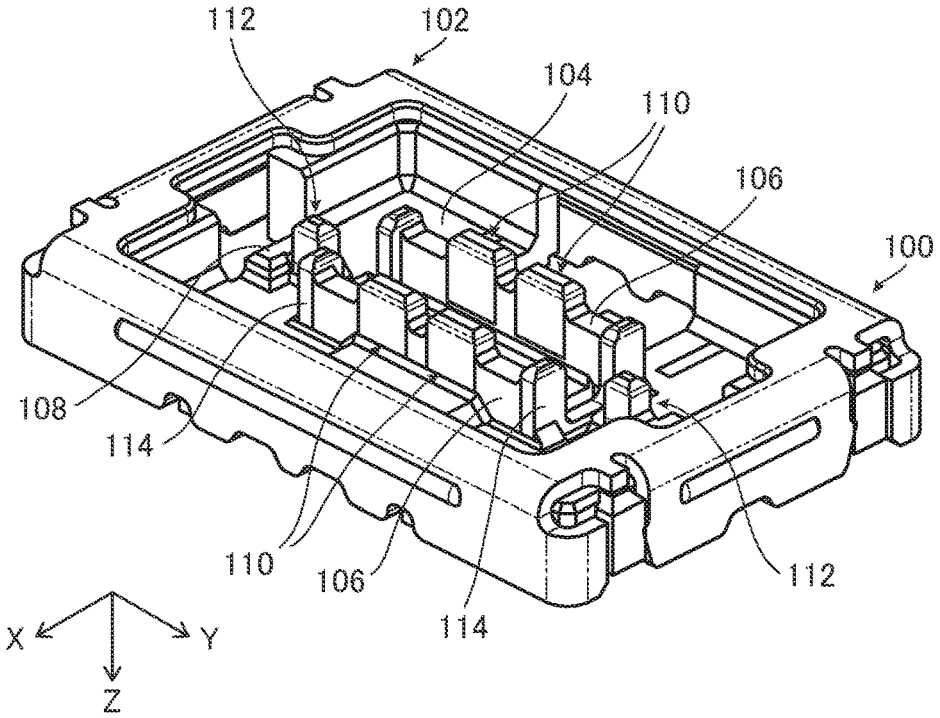
FIG. 7 is a perspective view of the counter connector when viewed from an upper side.
Figure 8:
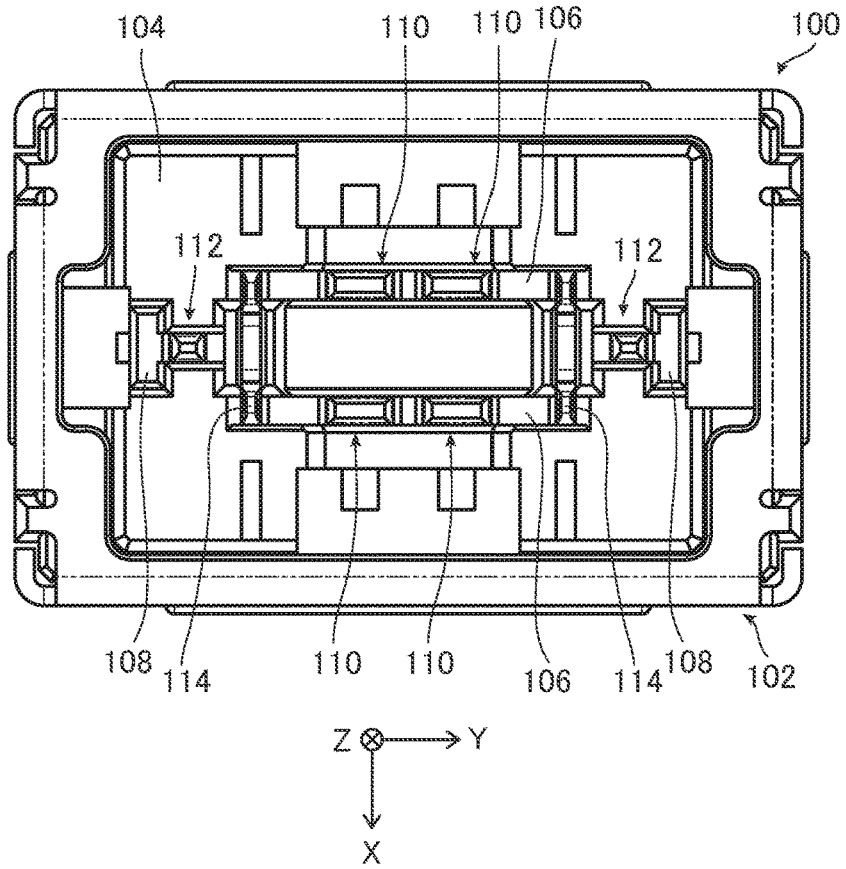
FIG. 8 is a plan view of the counter connector.

The counter connector 100 has the appearance shown in FIGS. 7 and 8 and includes a counter frame 102 having a rectangular shape in a plan view, a bottom wall 104 disposed inside the counter frame 102, projection portions 106 rising in a middle part in the Y direction of the bottom wall 104, and a jut portion 108 jutting from each of +Y side end and −Y side end of the bottom wall 104. Each of the projection portions 106 and the jut portions 108 is fitted with a counter contact 110 or 112. The counter contact 110 corresponds to the contact 30 of the connector 10, and the counter contact 112 corresponds to the contact 32 of the connector 10. Each of the contacts 30 and 32 of the connector 10 contacts and is electrically connected to the corresponding one of the counter contacts 110 and 112.

The structure of each portion of the connector 10 is described below.

As shown in FIGS. 3 to 6, the outer frame 12 has frame lateral portions 13 and 14 on the opposite sides in the X direction, the frame front portion 15 at the end on the +Y side, and the frame back portion 16 at the end on the −Y side. A recessed space 17 is formed inside the outer frame 12. In the state where the connector 10 is fitted with the counter connector 100, as shown in FIG. 2, the counter frame 102 of the counter connector 100 is fitted to the inside of the outer frame 12 of the connector 10 so that the entire counter connector 100 is accommodated in the recessed space 17.

Figure 3:
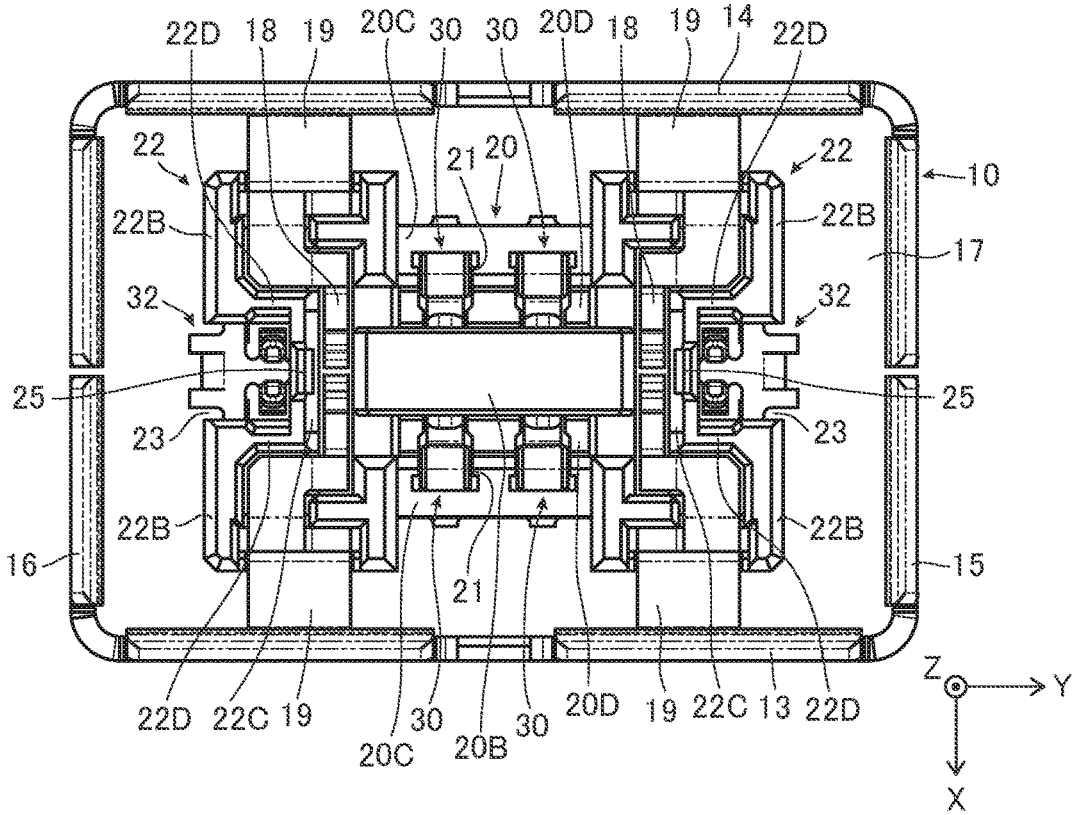
FIG. 3 is a plan view of the connector according to the embodiment of the invention.

As shown in FIG. 3, a pair of shield pieces 18 for preventing crosstalk is disposed on each of the +Y side and the −Y side in the recessed space 17. The pair of shield pieces 18 on the +Y side is situated slightly away from the frame front portion 15 toward the −Y side, and the pair of shield pieces 18 on the −Y side is situated slightly away from the frame back portion 16 toward the +Y side. The shield pieces 18 of a pair are linearly arranged in the X direction with a gap therebetween.

As shown in FIGS. 7 and 8, a pair of counter shield pieces 114 for preventing crosstalk is disposed on each of the +Y side and the −Y side in the counter connector 100 so as to correspond to the pair of shield pieces 18 of the connector 10. In the state where the connector 10 is fitted with the counter connector 100, the counter shield pieces 114 on the +Y side are combined with the shield pieces 18 on the +Y side to form a shield, and the counter shield pieces 114 on the −Y side are combined with the shield pieces 18 on the −Y side to form a shield. Thus, the shields are built between the contact 32 on the +Y side and the contact 32 on the −Y side to block transmission of signals (specifically, high frequency signals) between the contacts, thus minimizing crosstalk.

In the embodiment, as shown in FIG. 3, the outer frame 12 and the pair of shield pieces 18 are integrally formed; specifically, each shield piece 18 of a pair is joined to the frame lateral portion 13 or 14 by means of a joint portion 19.

The housings 20 and 22 are insulators made of insulating resin, are disposed in the recessed space 17, and are fixed with respect to the outer frame 12. In the embodiment, as shown in FIGS. 3 and 4, one housing 20 is disposed in a middle part in the Y direction of the recessed space 17, and two housings 22 are disposed separately on the opposite sides in the Y direction.

The housing 20 is disposed between the pair of shield pieces 18 on the +Y side and the pair of shield pieces 18 on the −Y side in the Y direction. As shown in FIGS. 3 and 4, the housing 20 has a housing bottom portion 20A, a middle projection portion 20B situated in a middle part in the X direction, lateral projection portions 20C situated on the opposite sides in the X direction of the middle projection portion 20B, and recessed portions 20D each formed between the middle projection portion 20B and the lateral projection portion 20C. The middle projection portion 20B and the lateral projection portions 20C project from the housing bottom portion 20A toward the +Z side and extend in the Z direction.

Figure 4:
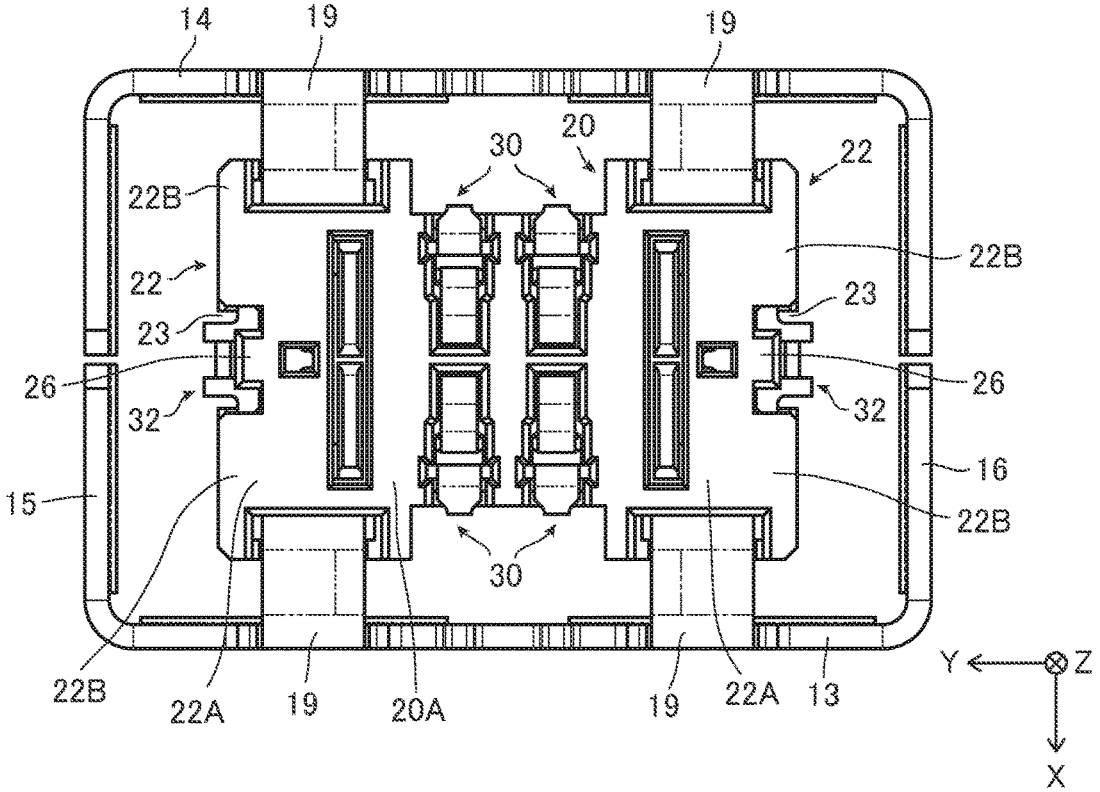
FIG. 4 is a bottom view of the connector according to the embodiment of the invention.
Figure 5:
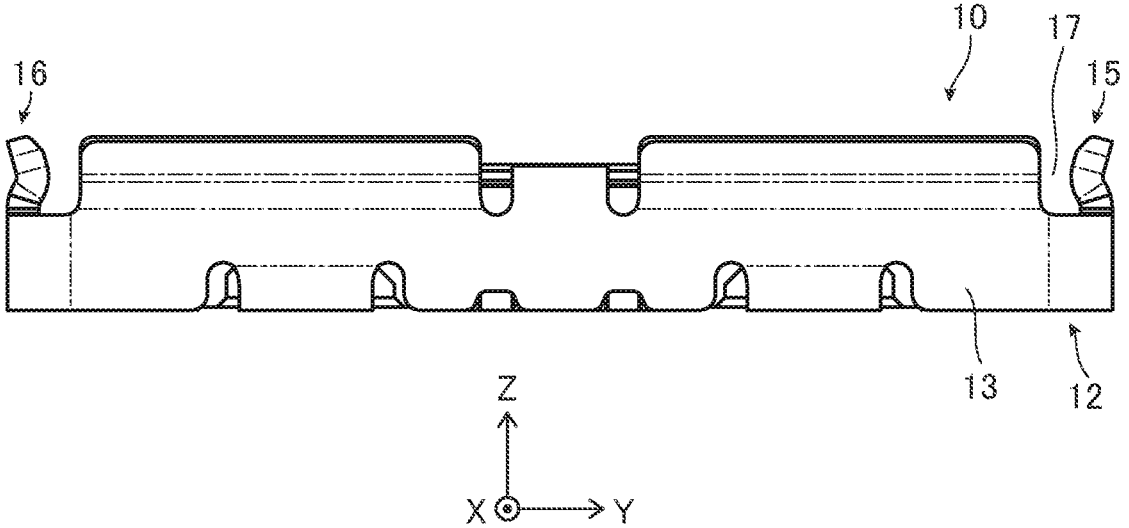
FIG. 5 is a side view of the connector according to the embodiment of the invention.
Figure 6:
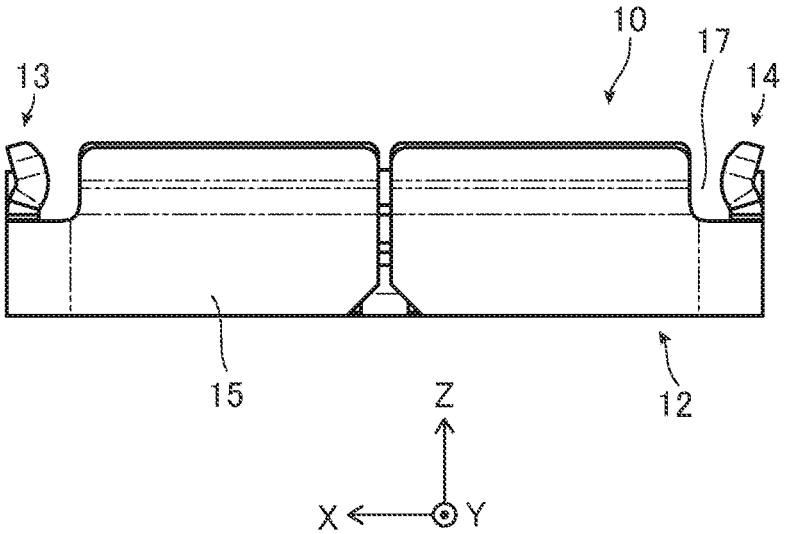
FIG. 6 is a front view of the connector according to the embodiment of the invention.

As shown in FIGS. 3 and 4, the housing 20 is provided with a plurality of fitting grooves 21 into which the contacts 30 are fitted. Each fitting groove 21 is formed to extend from the middle projection portion 20B to the lateral projection portion 20C across the recessed portion 20D. The fitting grooves 21 are arranged symmetrically with respect to the middle position in the X direction of the housing 20 to form pairs, and the pairs of fitting grooves 21 are disposed in plural places (two places in FIG. 3) at intervals in the Y direction. In the embodiment, a contact 30 for low frequency signal transmission or a contact 30 for power feeding is fitted into each fitting groove 21.

Each of the housings 22 corresponds to a "housing" of the invention and is disposed on the outer side of the pair of shield pieces 18 (at a position closer to the outer frame 12) in the Y direction. The housings 22 are disposed separately on the +Y side and the −Y side as shown in FIG. 3, and the two housings 22 are arranged to be symmetrical in the front-back direction but have the same structure; therefore, only the structure of the housing 22 on the +Y side is described below.

Figure 14:
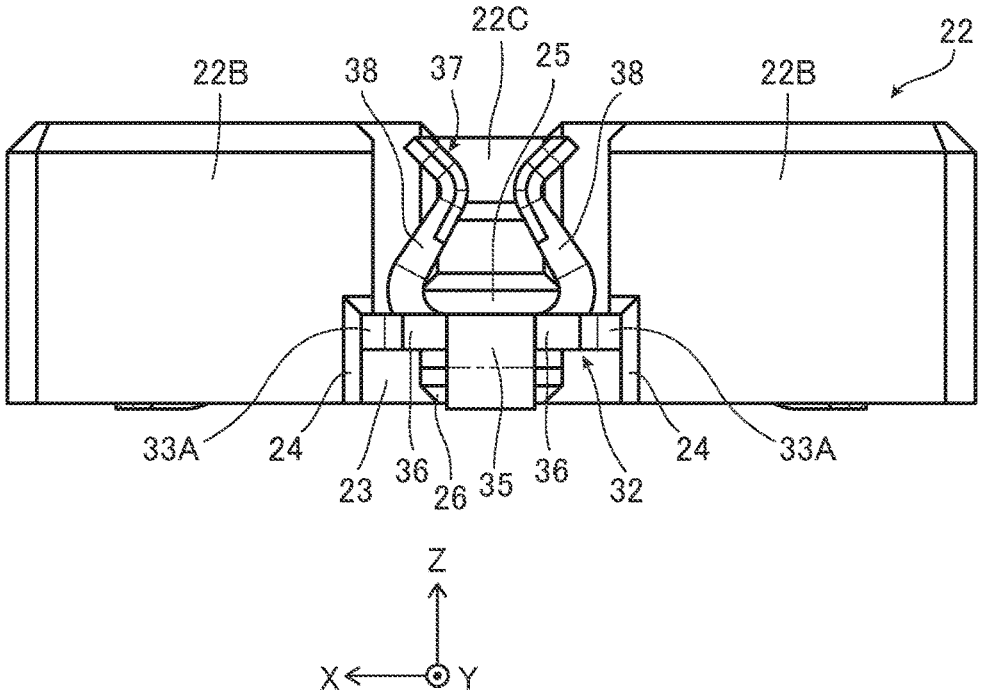
FIG. 14 is a front view of a housing to which the contact is attached.

The housing 22 has a symmetrical structure with respect to the middle position in the X direction of the connector 10 (see FIG. 14, for example) and, as shown in FIGS. 3, 4 and 14, has a housing bottom portion 22A, a pair of housing end portions 22B adjacent to the Y-directional end of the housing bottom portion 22A, and a rising portion 22C rising from the +Z side surface of the housing bottom portion 22A toward the +Z side.

Figure 15:
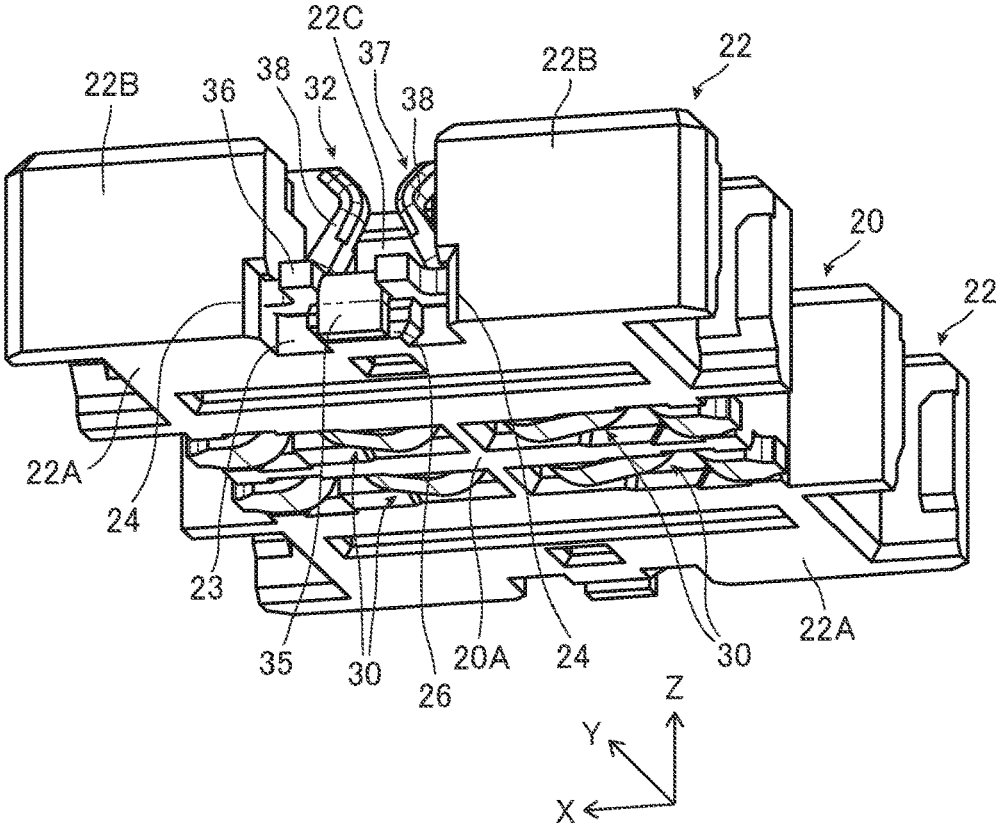
FIG. 15 is a perspective view of the housing to which the contact is attached.
Figure 16:
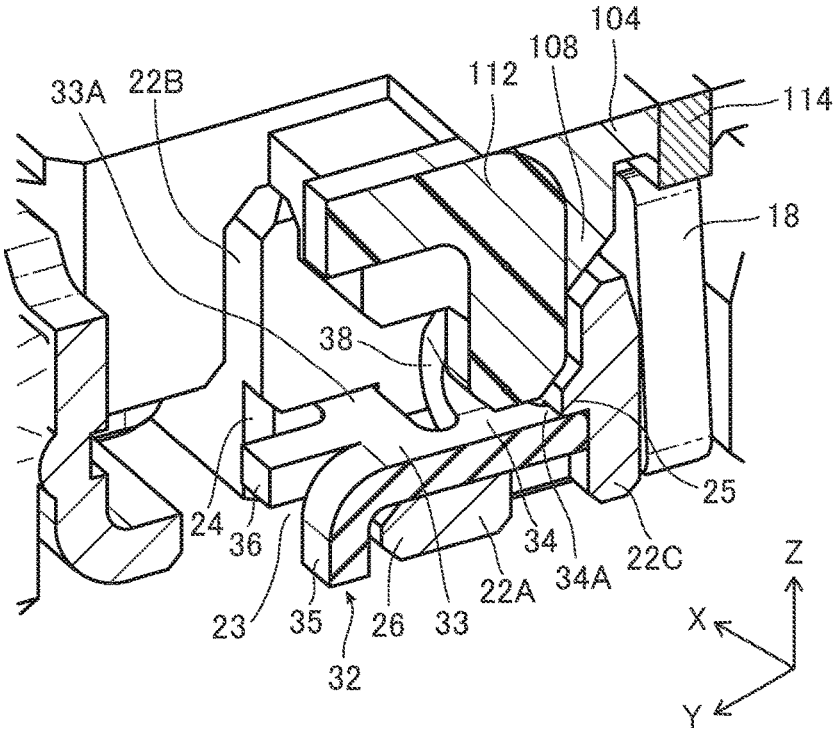
FIG. 16 is an enlarged cross-sectional perspective view showing the structure of a portion around the contact in a cross section taken along line I-I in FIG. 2.

As shown in FIGS. 3, 14 and 15, the housing end portions 22B of a pair are arranged with a gap therebetween in the X direction, and each housing end portion 22B rises toward the +Z side and extends in the X direction. As shown in FIG. 3, the rising portion 22C is provided between the housing end portions 22B of a pair in the X direction and situated at a position closer to the center of the recessed space 17 than the housing end portions 22B are, i.e., a position closer to the housing 20, in the Y direction. As shown in FIGS. 3 and 16, the rising portion 22C is disposed to adjoin the shield pieces 18 in the Y direction.

As shown in FIG. 3, a crossing portion 22D extends in the Y direction from the +X side end of the rising portion 22C toward the housing end portion 22B on the +X side, and another crossing portion 22D extends in the Y direction from the −X side end of the rising portion 22C toward the housing end portion 22B on the −X side.

As shown in FIGS. 3 and 15, the contact 32 is press-fitted along the Y direction into a recessed space (hereinafter called "fitting space 23") surrounded by the pair of housing end portions 22B, the rising portion 22C and the crossing portions 22D.

Specifically, as shown in FIG. 15, a press-fit recessed portion 24 is formed at a surface of each housing end portion 22B of a pair, which surface faces inward in the X direction, i.e., faces the fitting space 23. The press-fit recessed portion 24 is a recess having a substantially rectangular shape when viewed from the Y direction, and extends from the −Z side end (lower end) of the housing end portion 22B toward the +Z side to have a certain height and also extends in the Y direction from the outer end in the Y direction of the housing end portion 22B to have a certain depth. The contact 32 is press-fitted into the housing 22 through the press-fit recessed portions 24 provided separately to the housing end portions 22B of a pair.

As shown in FIGS. 14 and 16, in the fitting space 23, a protrusion portion 25 protrudes from the surface of the rising portion 22C that faces the fitting space 23 (in other words, the surface thereof that faces an extension portion 34 of the contact 32 which will be described later). The protrusion portion 25 protrudes outward in the Y direction and is situated on the +Z side of the housing bottom portion 22A, more strictly, at a position away from the +Z side surface of the housing bottom portion 22A by a distance corresponding to the thickness of the extension portion 34. The bottom surface (−Z side surface) of the protrusion portion 25 is a plane surface, more strictly, a flat surface extending along the XY direction.

The amount of protrusion of the protrusion portion 25 is preferably set so as not to interfere with the counter contact 112 when the connector 10 is fitted with the counter connector 100.

Further, in the fitting space 23, as shown in FIGS. 4, 15 and 16, a restriction portion 26 projects from the surface of the housing bottom portion 22A that faces the fitting space 23, specifically, the surface thereof that is situated between the housing end portions 22B of a pair in the X direction. The restriction portion 26 projects outward in the Y direction and is situated on the −Z side of the protrusion portion 25, more strictly, at a position lower than the protrusion portion 25 by a distance corresponding to the thickness of the extension portion 34. The top surface (+Z side surface) of the restriction portion 26 is a plane surface, more strictly, a flat surface extending along the XY direction.

Each of the contacts 32 corresponds to a "contact" of the invention and is fitted into and attached to the housing 22 on the +Y side or the housing 22 on the −Y side on a one for one basis. The contacts 32 in the embodiment are contacts for high frequency signal transmission, i.e., terminals for radio frequency (RF). The high frequency herein is equivalent to, for instance, a frequency band of not lower than 6 GHz, specifically, a frequency band including a 28 GHz band used for the 5th generation (5G).

However, the contacts 32 are not limited to contacts for high frequency signal transmission and may be contacts for transmitting signals in a general frequency band or low frequency signals.

The contact 32 in the embodiment is made of an electrically conductive material, such as metal, that is shaped into the appearance shown in FIGS. 9 to 13, and the shape is symmetrical with respect to the middle in the X direction of the contact 32. The contact 32 has a press-fitted portion 33 extending in the X direction, the extension portion 34 extending in the Y direction from the press-fitted portion 33, a connection portion 35 extending from the press-fitted portion 33 on the opposite side from the extension portion 34 in the Y direction, a pair of overhang portions 36 overhanging in the Y direction from the opposite sides of the connection portion 35, and a contact portion 37 extending from the extension portion 34 toward the +Z side.

For convenience of description, the Y direction is defined as a front-back direction of the contact 32, and the side on which the extension portion 34 extends when viewed from the press-fitted portion 33 in the Y direction is called "front side," while the side on which the connection portion 35 extends is called "back side."

Figure 9:
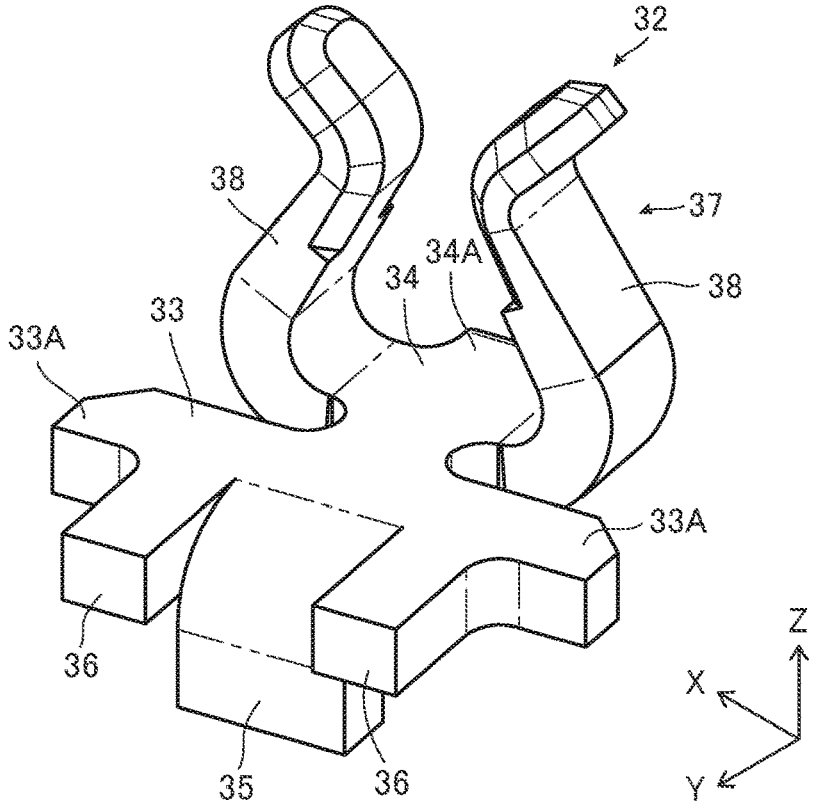
FIG. 9 is a perspective view of a contact according to the embodiment of the invention when viewed from a back side.
Figure 10:
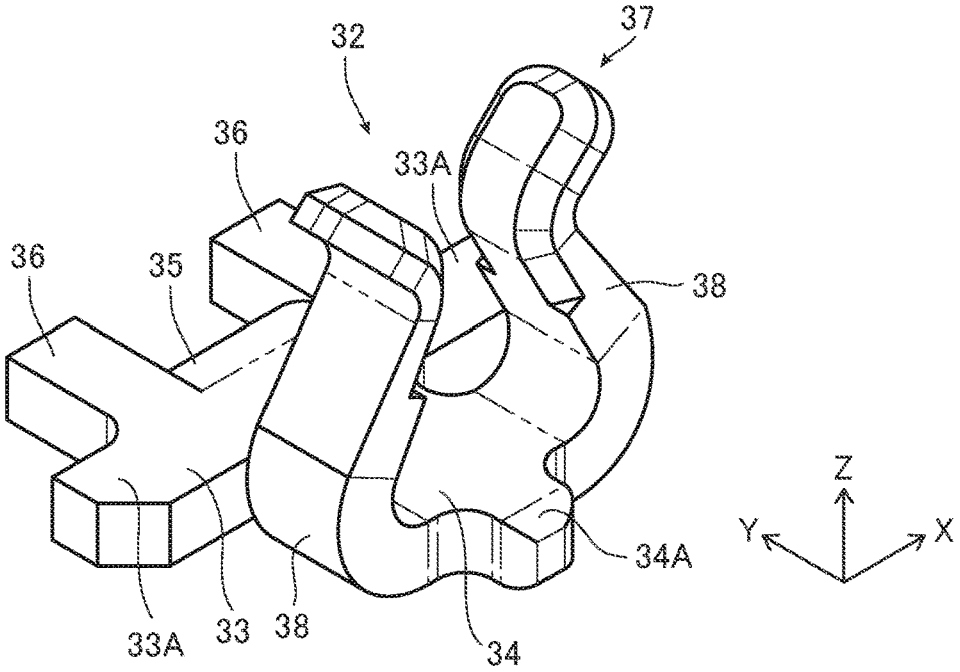
FIG. 10 is a perspective view of the contact according to the embodiment of the invention when viewed from a front side.
Figure 12:
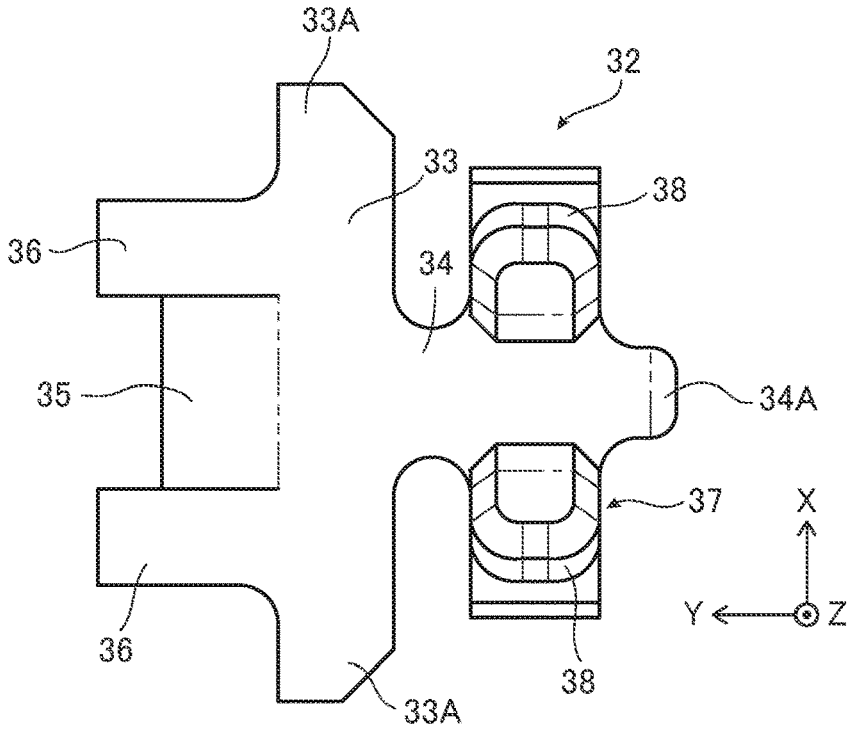
FIG. 12 is a plan view of the contact according to the embodiment of the invention.
Figure 13:
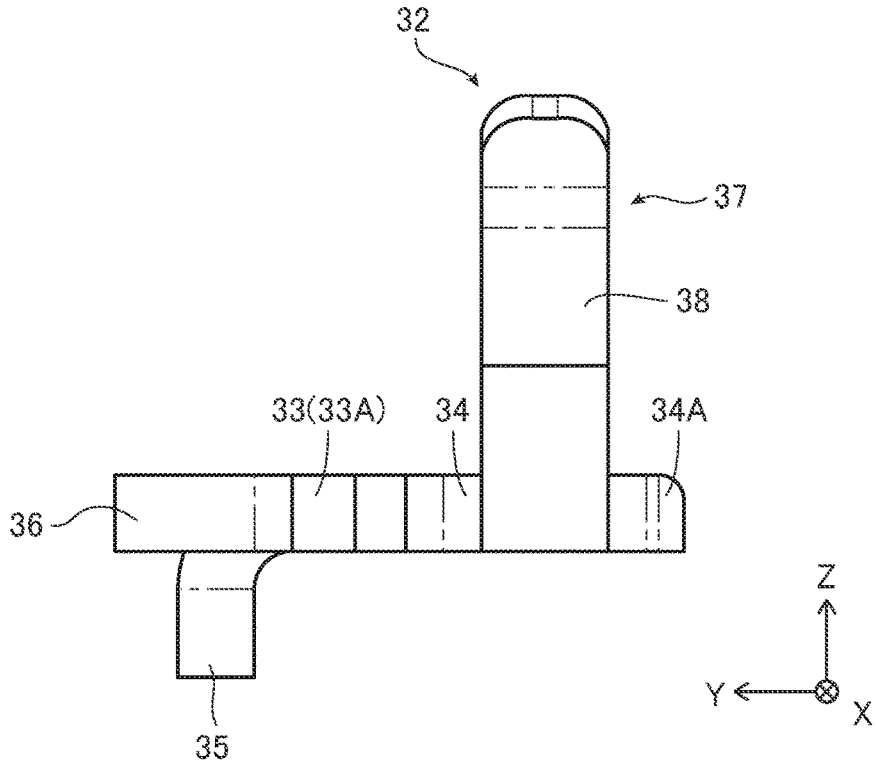
FIG. 13 is a side view of the contact according to the embodiment of the invention.

The press-fitted portion 33 has a substantially rectangular shape in a plan view and linearly extends in the X direction, and opposite end portions 33A thereof have front corners chamfered to form a trapezoidal shape, as shown in FIGS. 9 and 12. The width (i.e., the length in the X direction) of the press-fitted portion 33 is somewhat longer than the distance between the press-fit recessed portions 24 provided separately to the housing end portions 22B of a pair. The distance between the press-fit recessed portions 24 herein refers to the distance between the X-directional end surface of the press-fit recessed portion 24 provided to the housing end portion 22B on the +X side and the X-directional end surface of the press-fit recessed portion 24 provided to the housing end portion 22B on the −X side.

The opposite end portions 33A in the X direction of the press-fitted portion 33 are press-fitted into the housing 22. The press-fitting of the opposite end portions 33A of the press-fitted portion 33 is described later.

As shown in FIG. 9, the extension portion 34 linearly extends frontward from the front end of a middle part in the X direction of the press-fitted portion 33 and is perpendicular to the press-fitted portion 33. The base portion of the extension portion 34 narrows as shown in FIG. 12, specifically, narrows such that the opposite end surfaces in the X direction of the base portion are curved in a circular arc shape. The +Z side surface (i.e., the surface facing the counter connector 100) and the −Z side surface (i.e., the surface facing the opposite side from the counter connector 100) of the extension portion 34 are both plane surfaces, more strictly, flat surfaces extending along the XY direction.

As shown in FIG. 9, the connection portion 35 extends backward from the back end of the middle part in the X direction of the press-fitted portion 33 and is then curved toward the −Z side. The distal end portion of the connection portion 35 is soldered and fixed to a surface (surface facing the connector 10) of a circuit board on which the connector 10 is mounted.

As shown in FIG. 9, the overhang portions 36 of a pair are situated at positions sandwiching the connection portion 35 in the X direction and linearly extend backward from the back end of the press-fitted portion 33 in the Y direction. The +Z side surfaces of the press-fitted portion 33, the extension portion 34 and the overhang portions 36 of a pair are continuous with one another along the XY direction and present in the same plane. Likewise, the −Z side surfaces of the press-fitted portion 33, the extension portion 34 and the pair of overhang portions 36 are continuous with one another along the XY direction and present in the same plane.

Figure 11:
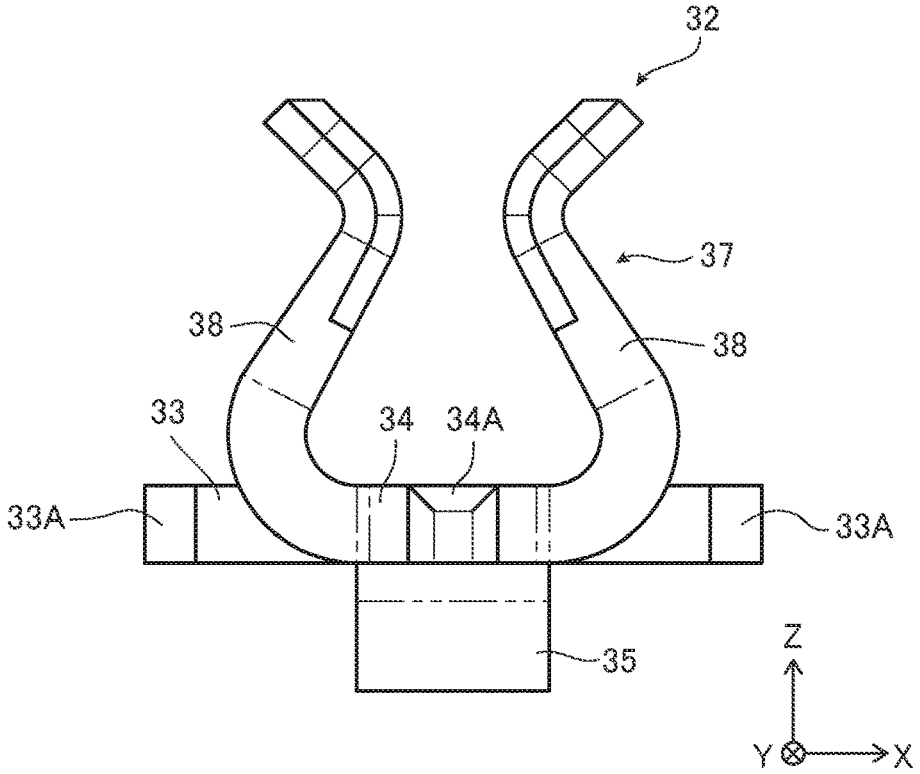
FIG. 11 is a front view of the contact according to the embodiment of the invention.

As shown in FIGS. 9 to 12, the contact portion 37 has a pair of elastic portions 38 extending from the opposite ends in the X direction of the extension portion 34 at an intermediate position of the extension portion 34 toward the +Z side. The pair of elastic portions 38 has a symmetric shape with respect to the middle position in the X direction of the extension portion 34. As shown in FIGS. 11 and 12, each elastic portion 38 extends from either end in the X direction of the extension portion 34, is thereafter curved in a circular arc shape to go toward the inner side in the X direction, and then is again bent in a V-shape at a position somewhat away from the extension portion 34 on the +Z side to extend outward in the X direction.

Figure 17:
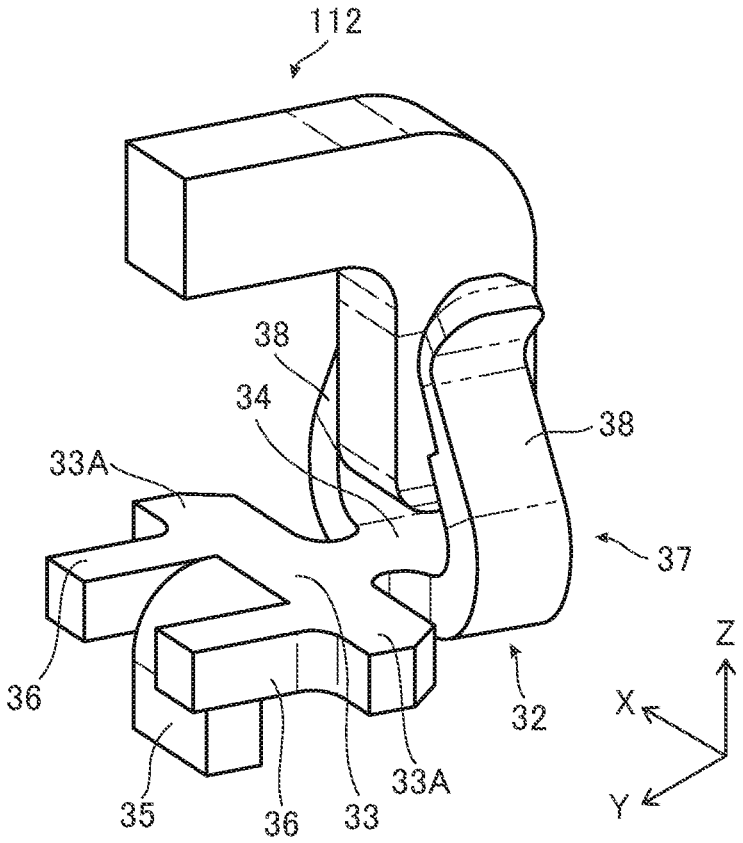
FIG. 17 is a perspective view showing the state where the contact is in contact with a counter contact.
Figure 18:
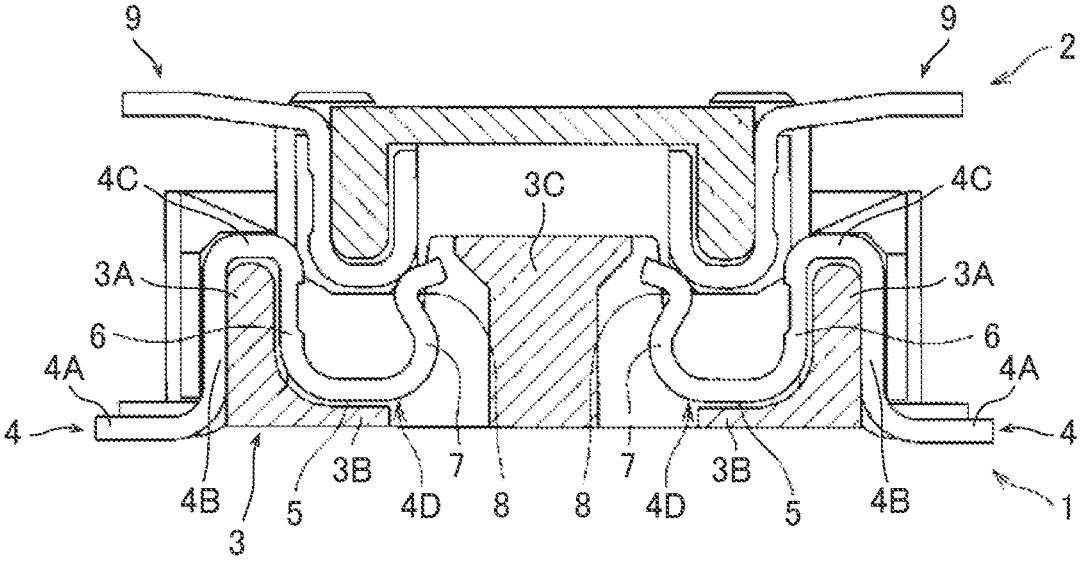
FIG. 18 PRIOR ART
FIG. 18 is a cross-sectional view showing the fitting structure between a contact and a counter contact in a conventional example, in the state where fitting is in process.

The contact portion 37 has an open end on the +Z side formed by the distal ends of the elastic portions 38 of a pair being spaced apart from each other. When the connector 10 is fitted to the counter connector 100, as shown in FIG. 17, the counter contact 112 is inserted toward the −Z side through the open end on the +Z side of the contact portion 37 and enters between the elastic portions 38 of a pair. At this time, the pair of elastic portions 38 elastically deforms so as to widen outward in the X direction and also pinches the counter contact 112 between the elastic portions 38. Consequently, the contact portion 37 contacts the counter contact 112 via the inner surfaces of the V-shaped bent portions of the elastic portions 38.

The contact 32 thus configured is fitted into the fitting space 23 in the housing 22 in the Y direction and thereby attached to the housing 22 as shown in FIGS. 14 and 15.

Specifically, the contact 32 is held such that the contact portion 37 is situated on the +Z side of the extension portion 34, and the contact 32 is, from the distal end side (i.e., the front end side) of the extension portion 34, inserted into the fitting space 23 through the open end in the Y direction of the fitting space 23. At this time, the opposite end portions 33A in the X direction of the press-fitted portion 33 enter the insides of the press-fit recessed portions 24 provided separately in the housing end portions 22B of a pair.

In the process that the contact 32 is advanced more deeply in the fitting space 23, each of the opposite end portions 33A of the press-fitted portion 33 interferes with the X-directional end surface of the press-fit recessed portion 24 and is advanced more deeply in the Y direction while being sunk into the X-directional end surface. Thus, the press-fitted portion 33 (more strictly, the opposite end portions 33A) of the contact 32 is press-fitted to the housing 22 along the Y direction.

The contact 32 is inserted into the fitting space 23, and finally, the distal end of the extension portion 34 abuts the rising portion 22C of the housing 22 (see FIG. 16). In other words, in the state where the press-fitted portion 33 is press-fitted in the housing 22, the rising portion 22C adjoins a distal end portion 34A of the extension portion 34 in the Y direction. The fitting process of the contact 32 is completed at the time when the contact 32 reaches the position as above, and thus, the contact 32 is attached to the housing 22.

In the state where the contact 32 is attached to the housing 22 (i.e., the press-fitted portion 33 is press-fitted in the housing 22), as shown in FIG. 16, the distal end portion 34A in the Y direction of the extension portion 34 goes into a space under (on the −Z side of) the protrusion portion 25, and the +Z side surface (top surface) of the distal end portion 34A of the extension portion 34 contacts the protrusion portion 25. That is, the extension portion 34 is locked by the protrusion portion 25 on the +Z side. With this configuration, upward movement (movement toward the +Z side) of the contact 32 is restricted. As a result, when the counter connector 100 fitted with the connector 10 is detached from the connector 10, floating of the contact 32 toward the +Z side can be minimized at the time of removal of the counter contact 112. Since floating is minimized as above, even when a large external force acts on the contact 32 at the time of removal of the counter contact 112, the occurrence of deformation and breakage of the contact 32 can be minimized.

In the embodiment, the contact surface (i.e., the +Z side surface) of the distal end portion 34A of the extension portion 34 that contacts the protrusion portion 25 and a contact surface (i.e., the −Z side surface) of the protrusion portion 25 that contacts the extension portion 34 are both plane surfaces extending along the XY direction. That is, the protrusion portion 25 makes a surface contact with the distal end portion 34A of the extension portion 34. Consequently, in the connector 10 of the embodiment, floating of the contact can be more appropriately minimized compared to the foregoing connector 1 described in JP 2012-18781 A.

Specifically, in the connector 1 described in JP 2012-18781 A, the counter contact 9 is inserted into the curved portion 4D of the contact 4 whereby the curved portion 4D elastically deforms such that the lateral portion 7 of the contact 4 approaches the projection portion 3C in the fitting process with the counter connector 2. As a result, the bent portion 8 goes into a space under the top portion of the projection portion 3C and is locked by the top portion, whereby floating of the contact 4 is restricted.

Figure 19:
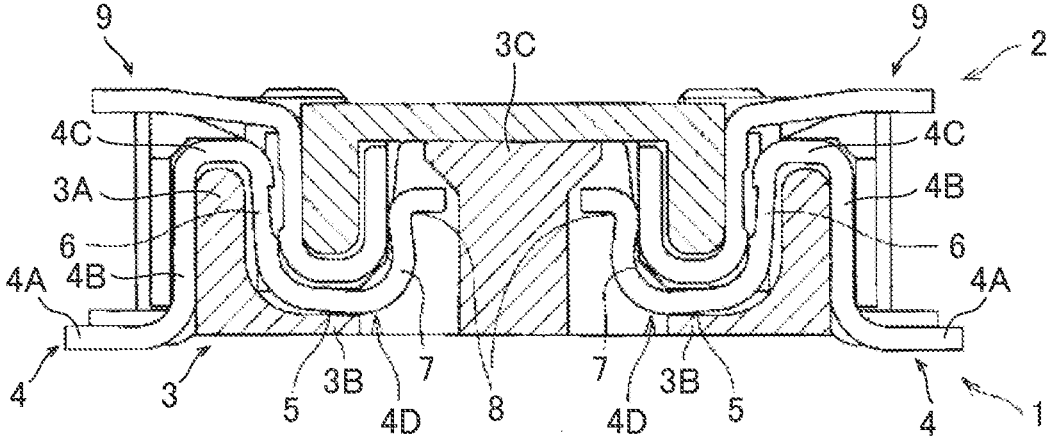
FIG. 19 PRIOR ART
FIG. 19 is a cross-sectional view showing the fitting structure between the contact and the counter contact in the conventional example, in the state where fitting is completed.

As described above, in the connector 1 described in JP 2012-18781 A, upward movement of the contact 4 is not restricted until the counter contact 9 is inserted in the curved portion 4D of the contact 4; therefore, upward movement of the contact 4 is hardly restricted after the counter contact 9 is pulled out. Aside from that, the connector 1 is configured such that the edge of the bent portion 8 hits the projection portion 3C whereupon floating of the contact 4 is restricted, as evident from FIG. 19; therefore, when the counter contact 9 is repeatedly inserted and pulled out, the projection portion 3C may be chipped away and deformed, or the elasticity of the curved portion 4D itself may change. Due to this, the contacting position between the projection portion 3C and the bent portion 8 may vary in the vertical direction, whereby the position of the contact 4 in the Z direction may change.

In contrast, in the connector 10 of the embodiment, once the contact 32 is fitted in the housing 22, the protrusion portion 25 of the housing 22 contacts the extension portion 34 of the contact 32, thereby locking the contact 32. With this configuration, it is possible to minimize floating of the contact 32 regardless of the presence or absence of the counter contact 112. Aside from that, in the embodiment, since the protrusion portion 25 makes a surface contact with the distal end portion 34A of the extension portion 34, the contacting state between the protrusion portion 25 and the extension portion 34 is stable, and the excellent contacting state can be maintained even with repetitive insertion and pull-out of the counter contact 112.

Moreover, the restriction portion 26 is provided at the housing bottom portion 22A and, as shown in FIG. 16, the restriction portion 26 contacts the bottom surface (−Z side surface) of each of the press-fitted portion 33 and the extension portion 34 in the state where the press-fitted portion 33 is press-fitted in the housing 22 so that the contact 32 is attached to the housing 22. That is, the restriction portion 26 contacts the extension portion 34 on the opposite side from the protrusion portion 25 in the Z direction, thereby locking the contact 32. With this configuration, downward movement (movement toward the −Z side) of the contact 32 is restricted, and for example, sinking of the contact 32 upon insertion of the counter contact 112 can be minimized.

As described above, the connector 10 of the embodiment makes it possible to appropriately restrict movement (displacement in position) of the contact 32 in the Z direction. This effect is particularly advantageous when the contact 32 is a contact (terminal) for high frequency signal transmission.

Specifically, a high frequency signal transmitted from the contact 32 has, for example, properties that depend on impedance between the shield described above and the contact 32, and the impedance varies depending on the distance between the shield and the contact 32. Here, if the contact 32 moves in the Z direction even slightly, the distance above changes accordingly, and that change in the distance may affect the properties of the high frequency signal. Under such a circumstance, the effect of the restriction of movement of the contact 32 in the embodiment is more remarkably demonstrated.

Other Embodiments

While the connector of the invention is described with a specific example as above, the foregoing embodiment is merely an example used to facilitate the understanding of the invention, and other embodiments are also possible.

In the embodiment above, when the contact 32 is fitted to the housing 22, the press-fitted portion 33 of the contact 32 is press-fitted into the housing 22 along the Y direction; however, the invention is not limited thereto. For instance, the contact 32 may be press-fitted from the underneath (−Z side) of the housing 22 along the Z direction.

In the embodiment above, the opposite end portions 33A in the X direction of the press-fitted portion 33 have front corners chamfered to form a trapezoidal shape, and the opposite end portions 33A enter the press-fit recessed portions 24 in the housing end portion 22B so as to interfere with the X-directional end surfaces of the press-fit recessed portions 24, thus being press-fitted into the housing 22. However, the invention is not limited thereto, it suffices if the contact 32 can be properly fitted into and attached to the housing 22, and other press-fitting processes may be adopted as long as the fitting and attachment of the contact 32 can be properly done.

In the embodiment above, there is provided the restriction portion 26 that contacts the extension portion 34 of the contact 32 on the lower side (−Z side) of the extension portion 34 in the Z direction of the housing 22 in addition to the protrusion portion 25 that contacts the extension portion 34 on the upper side (+Z side) of the extension portion 34; however, instead of the restriction portion 26, the housing bottom portion 22A may contact the extension portion 34 on the lower side (−Z side) of the extension portion 34.

What is claimed is:

1. A connector fittable with a counter connector in a first direction, the connector comprising:

a contact that contacts a counter contact included in the counter connector; and a housing to which the contact is fitted and attached, the contact including:

a press-fitted portion that extends in a second direction intersecting the first direction and has an end portion in the second direction which is press-fitted into the housing;

an extension portion that extends from the press-fitted portion in a third direction intersecting the first direction and the second direction; and a contact portion that extends from the extension portion in the first direction and contacts the counter contact, the housing including:

a rising portion that rises in the first direction; and a protrusion portion that protrudes from the rising portion in the third direction, wherein in a state where the press-fitted portion is press-fitted in the housing, a surface of a distal end portion in the third direction of the extension portion contacts the protrusion portion, which surface faces a side where the counter connector is situated in the first direction.

2. The connector according to claim 1, wherein when the contact is fitted to the housing, the press-fitted portion is press-fitted into the housing along the third direction.

3. The connector according to claim 1, wherein the contact portion has a pair of elastic portions that extends from opposite end surfaces in the second direction of the extension portion, and the pair of elastic portions has a symmetric shape with respect to a middle position in the second direction of the extension portion, and when the connector is fitted to the counter connector, the pair of elastic portions elastically deforms to pinch the counter contact between the elastic portions.

4. The connector according to claim 1, wherein the contact has a connection portion that extends from the press-fitted portion on an opposite side from the extension portion in the third direction, and the connection portion is fixed to a surface of a circuit board on which the connector is mounted.

5. The connector according to claim 1, wherein a contact surface that is provided in the distal end portion of the extension portion and contacts the protrusion portion and a contact surface that is provided in the protrusion portion and contacts the extension portion are plane surfaces extending along the second direction and the third direction.

6. The connector according to claim 1, wherein the contact is a contact for high frequency signal transmission.

7. The connector according to claim 1, wherein in the state where the press-fitted portion is press-fitted in the housing, the rising portion adjoins the distal end portion of the extension portion in the third direction, and the protrusion portion protrudes from a surface of the rising portion which surface faces the extension portion.

8. The connector according to claim 1, wherein the housing has a restriction portion that contacts the extension portion on an opposite side from the protrusion portion in the first direction in a state where the press-fitted portion is press-fitted in the housing.

9. The connector according to claim 2, wherein the contact portion has a pair of elastic portions that extends from opposite end surfaces in the second direction of the extension portion, and the pair of elastic portions has a symmetric shape with respect to a middle position in the second direction of the extension portion, and when the connector is fitted to the counter connector, the pair of elastic portions elastically deforms to pinch the counter contact between the elastic portions.

10. The connector according to claim 2, wherein the housing has a restriction portion that contacts the extension portion on an opposite side from the protrusion portion in the first direction in a state where the press-fitted portion is press-fitted in the housing.

11. The connector according to claim 3, wherein the housing has a restriction portion that contacts the extension portion on an opposite side from the protrusion portion in the first direction in a state where the press-fitted portion is press-fitted in the housing.

12. The connector according to claim 4, wherein the housing has a restriction portion that contacts the extension portion on an opposite side from the protrusion portion in the first direction in a state where the press-fitted portion is press-fitted in the housing.

13. The connector according to claim 5, wherein the housing has a restriction portion that contacts the extension portion on an opposite side from the protrusion portion in the first direction in a state where the press-fitted portion is press-fitted in the housing.

14. The connector according to claim 6, wherein the housing has a restriction portion that contacts the extension portion on an opposite side from the protrusion portion in the first direction in a state where the press-fitted portion is press-fitted in the housing.

15. The connector according to claim 7, wherein the housing has a restriction portion that contacts the extension portion on an opposite side from the protrusion portion in the first direction in a state where the press-fitted portion is press-fitted in the housing.

16. The connector according to claim 9, wherein the housing has a restriction portion that contacts the extension portion on an opposite side from the protrusion portion in the first direction in a state where the press-fitted portion is press-fitted in the housing.

* * * * *